US010597930B2

(12) United States Patent
Kornish

(10) Patent No.: US 10,597,930 B2
(45) Date of Patent: Mar. 24, 2020

(54) IMPACT RATED LIGHT FRAME FOR SECTIONAL DOORS

(71) Applicant: OVERHEAD DOOR CORPORATION, Lewisville, TX (US)

(72) Inventor: Dwayne J. Kornish, Navarre, OH (US)

(73) Assignee: OVERHEAD DOOR CORPORATION, Lewisville, TX (US)

( * ) Notice: Subject to any disclaimer, the term of this patent is extended or adjusted under 35 U.S.C. 154(b) by 208 days.

(21) Appl. No.: 15/439,691

(22) Filed: Feb. 22, 2017

(65) Prior Publication Data

US 2018/0238102 A1 Aug. 23, 2018

(51) Int. Cl.

*E06B 3/72* (2006.01)
*E06B 3/70* (2006.01)
*E06B 3/48* (2006.01)

(52) U.S. Cl.

CPC ..... *E06B 3/7001* (2013.01); *E06B 3/485* (2013.01); *E06B 3/72* (2013.01); *E06B 2003/7044* (2013.01)

(58) Field of Classification Search

CPC ..... E06B 3/485; E06B 3/7001; E06B 3/7015; E06B 3/549; E06B 3/04; E06B 3/5892; E06B 3/66; E06B 3/6621; E06B 5/10; E06B 2003/7044; E06B 5/116; E06B 5/12

USPC ..... 52/204.62, 204.6, 203, 204.5, 204.53, 52/204.72, 770, 781.3, 786.1

See application file for complete search history.

(56) References Cited

U.S. PATENT DOCUMENTS 2,374,056 A 4/1945 Watkins
3,855,994 A * 12/1974 Evans ..... F24C 15/04 126/198
4,733,510 A 3/1988 Werner
4,897,975 A 2/1990 Artwick et al.
4,920,718 A * 5/1990 Artwick ..... E06B 3/549 52/204.591
5,189,862 A 3/1993 Lafleur
5,497,588 A * 3/1996 Martin ..... E06B 3/5892 52/208
5,570,548 A 11/1996 Hopper
5,577,355 A 11/1996 Leonelli
5,636,484 A * 6/1997 DeBlock ..... E06B 3/5892 52/171.1
5,644,881 A * 7/1997 Neilly ..... E06B 3/5892 49/505
5,836,119 A * 11/1998 Emmanuel ..... E06B 3/26345 52/204.71
5,894,706 A * 4/1999 Herbst ..... E06B 3/22 160/369
5,941,031 A * 8/1999 Fullwood ..... E06B 3/00 52/202

(Continued)

*Primary Examiner* — Chi Q Nguyen
(74) *Attorney, Agent, or Firm* — Haynes and Boone, LLP

(57) ABSTRACT

An impact rated frame for sectional doors includes a frame assembly sandwiching a shield member and securely clamping a planar portion of a sectional door. The frame assembly and the shield member are fastened together with a plurality of fasteners driven through the frame assembly and the shield member. The impact rated frame further includes a decorative frame affixed to the frame assembly. The decorative frame seals against the planar portion of the sectional door and the shield member to prevent the frame assembly from contamination. The shield member may be transparent or opaque with multiple louvers.

20 Claims, 6 Drawing Sheets

(56) References Cited

U.S. PATENT DOCUMENTS

| | | | | |
|---|---|---|---|---|
| 6,151,849 | A | 11/2000 | Twigg et al. | |
| 6,272,801 | B1 * | 8/2001 | Suh | E06B 3/5892 49/505 |
| 6,318,037 | B1 | 11/2001 | Hansen | |
| 6,546,682 | B1 | 4/2003 | DeBlock et al. | |
| 6,647,677 | B1 * | 11/2003 | Berger, Jr. | E06B 3/5892 52/204.1 |
| 6,708,458 | B1 | 3/2004 | Berger, Jr. | |
| 6,722,083 | B2 * | 4/2004 | Herrmann | A47F 3/0434 49/501 |
| 6,837,011 | B2 | 1/2005 | Berger, Jr. | |
| 7,954,285 | B2 * | 6/2011 | Taylor | E06B 3/5892 52/204.53 |
| 8,201,367 | B2 | 6/2012 | Barnard et al. | |
| 8,479,462 | B1 * | 7/2013 | Sahadeo | E06B 3/28 160/368.1 |
| 8,813,442 | B1 | 8/2014 | Edwards et al. | |
| 9,022,091 | B2 | 5/2015 | Shives | |
| 2003/0000164 | A1 | 1/2003 | Berger, Jr. | |
| 2003/0066256 | A1 | 4/2003 | DeBlock et al. | |
| 2005/0055906 | A1 | 3/2005 | Barnard | |
| 2007/0193140 | A1 | 8/2007 | Carnick et al. | |
| 2007/0261326 | A1 | 11/2007 | Krochmal et al. | |
| 2009/0241422 | A1 | 10/2009 | Mock et al. | |
| 2009/0277109 | A1 | 11/2009 | Taylor et al. | |
| 2010/0287839 | A1 | 11/2010 | Barnard et al. | |
| 2012/0055106 | A1 | 3/2012 | Phipps | |
| 2014/0232072 | A1 | 8/2014 | Ayguen | |
| 2018/0238102 | A1 | 8/2018 | Kornish | |

* cited by examiner

IMPACT RATED LIGHT FRAME FOR SECTIONAL DOORS

TECHNICAL FIELD

The present disclosure relates to a multi-section door, more particularly, to a frame installable to an impact resistant multi-section door, and even more particularly, to an impact rated light frame suitable for use in impact resistant multi-section doors.

BACKGROUND

Multi-section doors for closing a large opening in a building, such as a sectional door, have long been manufactured using a plurality of substantially identical sections. The plurality of sections are typically hingedly or pivotally connected together to permit relative hinging movement between adjacent sections when the door is moved between a closed, vertical position, and an open, horizontal position.

Such multi-section doors are commonly referred to as upward opening sectional doors and often include sectional panels formed of a shell or casing, such as a molded or stamped piece of metal, fiberglass, or plastic, and an insulating core. In some cases, the multi-section door includes windows positioned within one or more of the sectional panels to allow users to view through a portion of the door. Due to the lightweight shell and core used to form the sectional panels, multi-section doors often require cumbersome, external framing structures to hold the windows in place within an opening cut into the sectional panel. The windows and framing structures of such doors often provide for a limited viewing area through the door, have low resistance to wind forces and flying debris that may occur in hurricane-prone areas, and are heavy additions to the sectional panels.

SUMMARY

This disclosure presents a new impact rated light frame for sectional doors. The impact rated light frame includes an aluminum exterior light frame and an aluminum interior light frame for robust construction and long lasting use. A decorative trim piece is added onto the exterior light frame to seal off dirt, rain, or other contaminants from deteriorating the frame assembly. A polycarbonate glazing may be used, with or without louvers, to permit light and ventilation. For example, the polycarbonate glazing may be a transparent sheet of ⅛" or ¼" thick with assembly holes near all edges. The assembly holes allow screws tightening the exterior and interior frames to pass through. For example, the aluminum exterior frame overlaps the assembly holes and sandwiches the polycarbonate glazing with the interior frame. When the polycarbonate glazing is impacted with a heavy load, the perimeter of the glazing is secured by the exterior and interior frame and the impact energy is dissipated and absorbed by the frame assembly. Detail of the present invention is further disclosed as follows. In other examples, the polycarbonate glazing may be a metal piece having multiple louvers for ventilation.

In a first aspect, there is provided an impact rated window frame assembly for support within an opening of a sectional door. The frame assembly includes an interior frame member, at least a portion of the interior frame member is disposed on a first side of the sectional door, and an exterior frame member for support at least partially on a second and opposite side of the sectional door. The assembly further includes a shield member disposed between the interior and exterior frame members a plurality of fasteners extending through the interior frame member. The exterior frame member and the shield member sandwich the shield member between the interior and exterior frame members and to secure the interior and exterior frame members within the opening of the sectional door.

In some embodiment, the plurality of fasteners extend around a perimeter of the shield member.

In yet other embodiments, the frame assembly includes a decorative frame member, the decorative frame member interlocking with the exterior frame member to encircle the opening in the sectional door.

In still other embodiments, the decorative frame member includes a slot to receive a corresponding extension on the exterior frame member to interlock the decorative frame member to the frame assembly.

In other embodiments, the decorative frame member includes a first slot for holding a first sealing member that seals against a planar portion of the sectional door and a second slot for supporting a second sealing member against the shield member.

In yet another embodiment, the first and the second sealing members are formed of a rubber material.

In other embodiments, the exterior frame includes a threaded hole and the interior frame comprises a through hole coaxially aligned with the threaded hole, the exterior frame is fastened to the interior frame by a screw extending through the coaxially aligned holes.

In yet another embodiment, the exterior frame member further includes a first raised edge for abutting against a second raised edge of the interior frame to define a space for sandwiching the shield member.

In still other embodiments, the shield member is transparent.

In another embodiment, the shield member includes a plurality of louvers.

According to a second aspect, there is provided a sectional door having at least one door panel movable between a closed and an open position. The door panel includes a planar surface having at least one opening extending through the planar surface. The sectional door further includes an impact window frame assembly having an interior frame member, at least a portion of the interior frame member disposed on a first side of the planar surface, an exterior frame member disposed on a second and opposite side of the sectional door and a shield member disposed between and supported by the interior and exterior frame members. A plurality of fasteners extend through the interior frame member, the exterior frame member and the shield member to sandwich the shield member between the interior and exterior frame members and to secure the interior and exterior frame members within the opening of the sectional door.

According to some embodiments, the plurality of fasteners extends around a perimeter of the shield member.

According to other embodiments, the frame assembly includes a decorative frame member, the decorative frame member interlocking with the exterior frame member to encircle the opening in the sectional door.

In yet other embodiments, the decorative frame member includes a slot to receive a corresponding extension on the exterior frame member to interlock the decorative frame member to the frame assembly.

In still other embodiments, the exterior frame includes an extrusion for inserting into a corresponding slot of the decorative frame, the decorative frame formed of an elastically deformable material.

In other embodiments, the decorative frame includes first slot for holding a first sealing member that seals against the planar portion of the sectional door and a second slot for holding a second sealing member that seals against the shield member.

In still another embodiment, the exterior frame includes a threaded hole and the interior frame comprises a through hole aligned with the threaded hole such that the exterior frame is fastened toward the interior frame by a screw disposed within the aligned threaded holes.

In yet another embodiment, the exterior frame further includes a first raised edge for abutting against a second raised edge of the interior frame to define a space for enclosing the shield member.

In a third aspect, there is provided a method for producing a sectional door panel with impact rated frames. The method includes cutting an opening in a planar surface of the sectional door panel, inserting an extrusion of an exterior frame into a corresponding slot of a decorative frame, wherein the decorative frame is elastically deformable during the insertion. The method further includes inserting the exterior frame into the opening of the sectional door panel, placing a shield member in the exterior frame and enclosing the shield member with an interior frame, the interior frame having a back support pressing the planar surface against the exterior frame. The method also includes tightening, via a fastener, the interior frame to the exterior frame to cause sealing members in the decorative frame to seal against the shield member and the planar surface of the sectional door panel.

In some embodiments, the step of tightening the interior frame to the exterior frame further includes inserting the fastener through the shield member.

For a more complete understanding of the present invention, including additional features, objects and advantages thereof, reference is now made to the following detailed description taken in conjunction with the drawings, in which:

DETAILED DESCRIPTION

Figure 1:
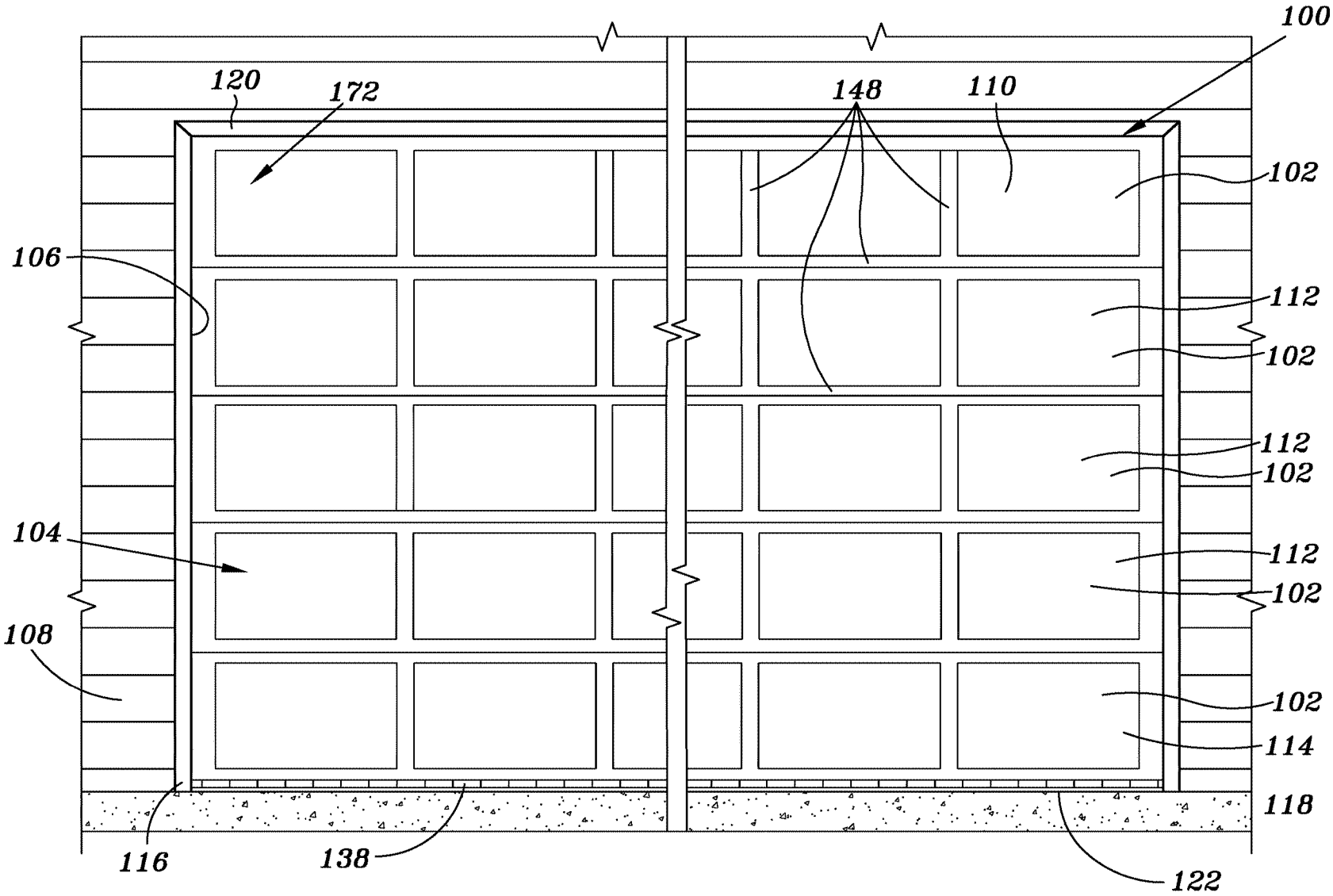
FIG. 1 is a front view of an embodiment of a multi-section door in which an impact rated window frame assembly is employed to advantage.

FIG. 1 is a front view of an embodiment of an upward acting sectional door 100 in which an impact rated window frame assembly 102 is employed to advantage. In the embodiment illustrated in FIG. 1, the upward-acting sectional door 100 is rated for areas prone to receive hurricane force winds while still providing the ability for persons to view through window assemblies 102. As illustrated, the door 100 includes a plurality of panels that together form a front face 104 and enclose an opening 106 in a building 108 or other structure. In the embodiment illustrated in FIG. 1, for example, the door 100 includes a number of panels, namely, a top panel 110, a plurality of intermediate panels 112 and a bottom panel 114 that enclose the opening 106 defined by two jambs 116, 118, a header 120 and a driveway or other bottom surface 122. In some embodiments, the panels include one or more openings 172 for receiving the impact rated window frame assemblies 102, as discussed in greater detail below. It should be understood that although all of the top panel 110, the intermediate panels 112, and the bottom panel 114 have multiple openings 172 as illustrated in FIG. 1, in other embodiments, one or more of the panels 110, 112 and/or 114 may be formed without any openings 172. According to some embodiments, the openings 172 are separated by non-deformed planar surfaces 148 that form the front faces 104 of the panels 110, 112 and 114.

Figure 2:
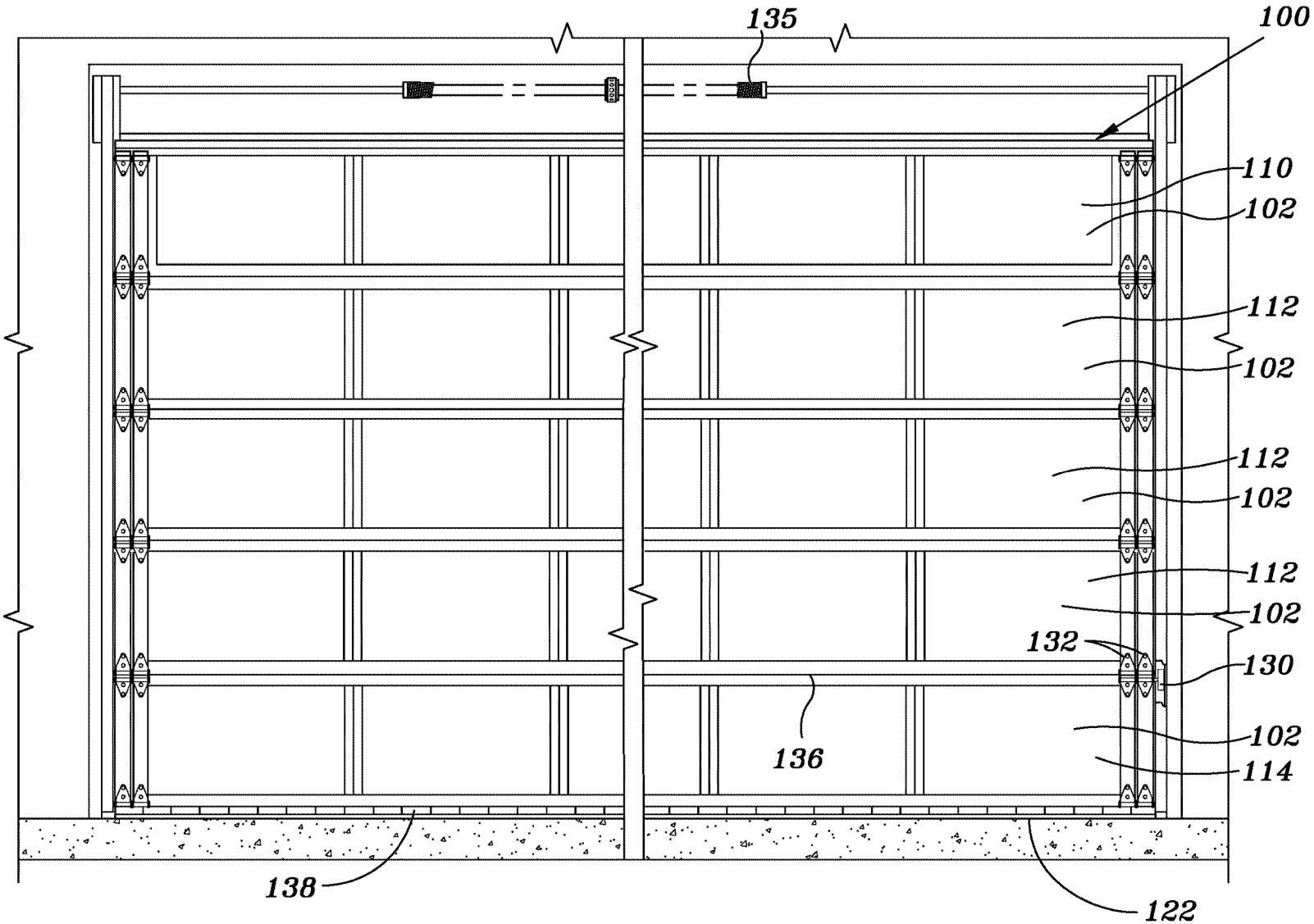
FIG. 2 is a rear view of the multi-section door of FIG. 1.

Referring to FIG. 2, the panels 110, 112 and 114 are hingedly connected and mounted on conventional track and rollers 130 to enable movement of the door 100 between a vertical (closed) position shown in FIGS. 1 and 2, and a horizontal (i.e., open or overhead) position.

Figure 3:
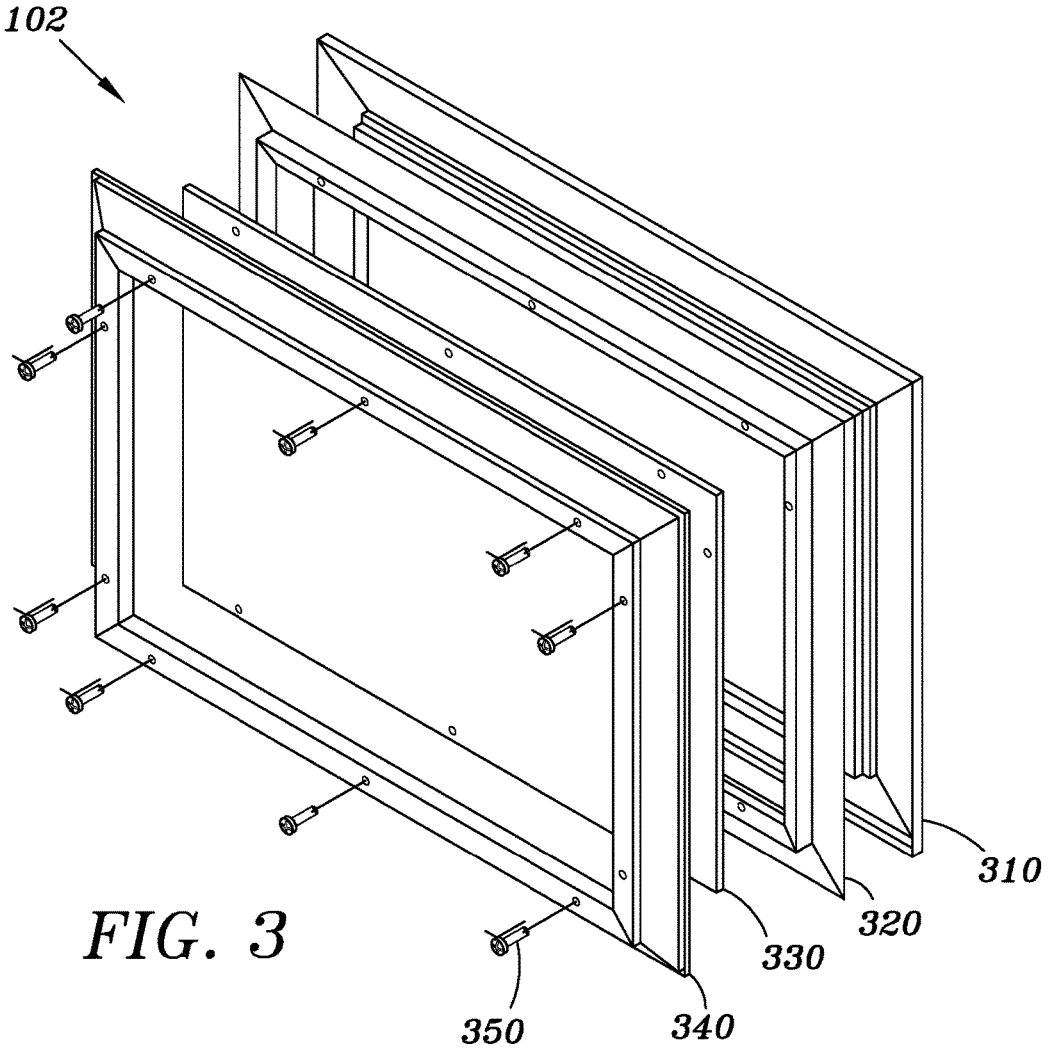
FIG. 3 is an exploded view of the impact rated window frame of the multi-section door of FIG. 1.
Figure 4:
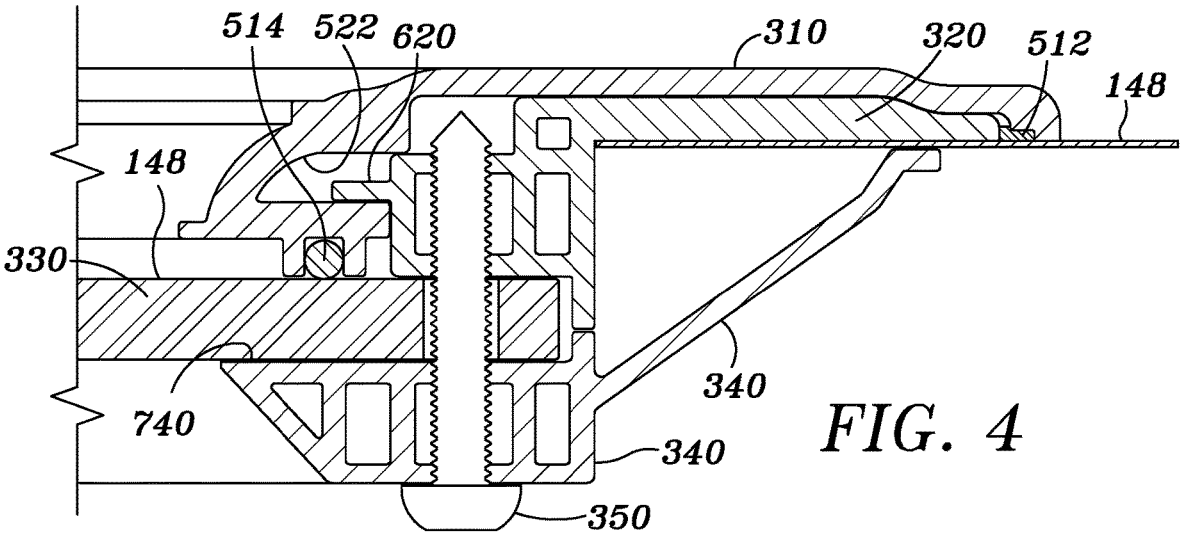
FIG. 4 is a cross sectional view of a portion of the assembled impact rated window frame of FIG. 3.

Referring specifically to FIGS. 3 and 4, the impact rated window frame assembly 102 includes a decorative frame 310, an exterior frame 320, an interior frame 340 and a shield member 330. In the embodiment illustrated in FIGS. 3 and 4, the shield member 330 is sandwiched between the interior frame 320 and exterior frame 340, which securely clamp the assembly 102 onto the planar portion 148 of the door 100 via a plurality of fasteners 350 extending through exterior frame 320, shield member 330 and interior frame 340.

Figure 5:
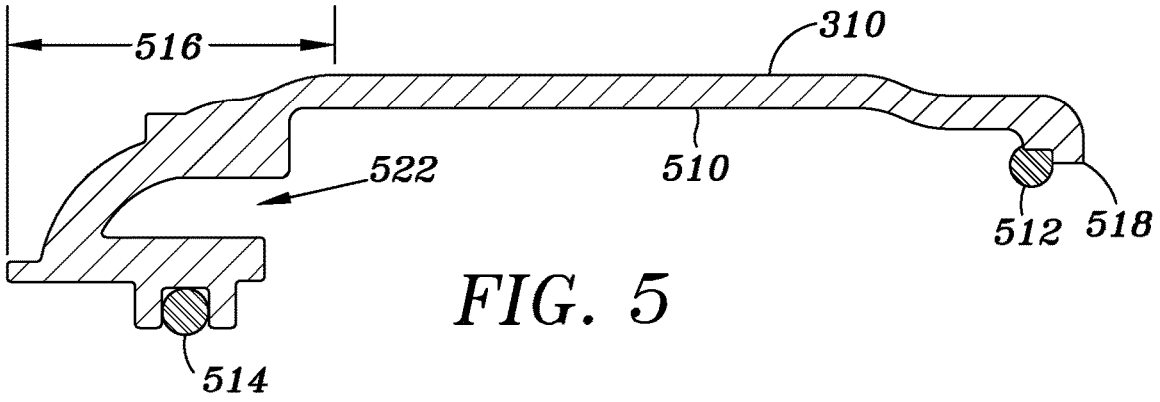
FIG. 5 is a cross sectional view of a decorative frame of FIG. 4.
Figure 6:
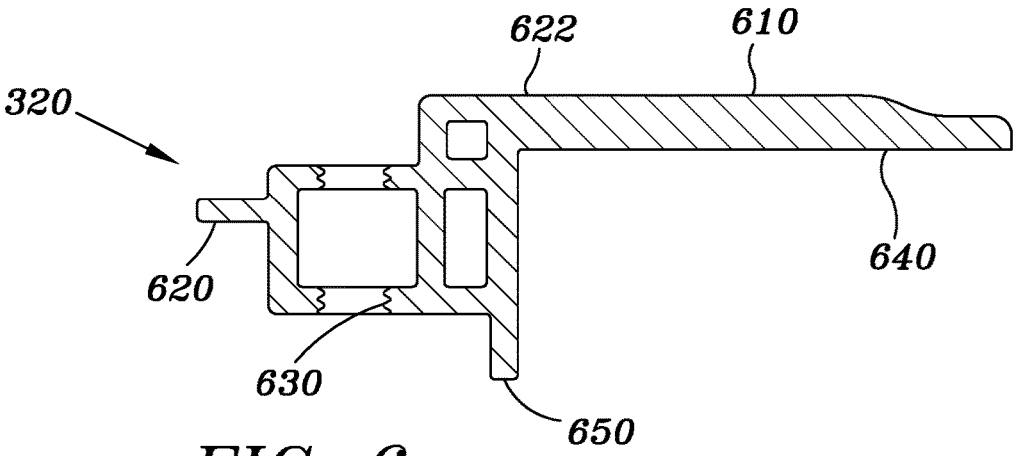
FIG. 6 is a cross sectional view of the exterior frame of the frame assembly of FIG. 3.

With reference to FIGS. 4 through 6, the decorative frame 310 includes a body 510 formed having an inner surface 530 and an outer surface 532. According to some embodiments, the inner surface 530 is recessed and/or otherwise configured to form a cavity 534 to receive and mate with at least a portion of the exterior frame 320. In the embodiment illustrated in FIG. 5, a slot 522 is oriented such that a slot opening 524 forms a passageway into and otherwise faces the cavity 534 to receive an extrusion 620 formed on the exterior frame 320, as discussed in greater detail below.

With continued reference to FIG. 5, a groove 536 is formed near a first end 518 for receiving a seal 512 therein and a second groove 538 is formed near a second end 520 for receiving a seal 514 therein, for sealing the window frame assembly 102 within the panel opening 172. In the embodiment illustrated in FIG. 5, the second end 520 further includes an inner frame section 516 that frames and otherwise borders the shield member 330. According to some embodiments, the inner frame section 516 is sloped downwardly toward the shield member 330 to "frame" or otherwise provide an aesthetically pleasing transition toward the shield member 330.

Figure 7:
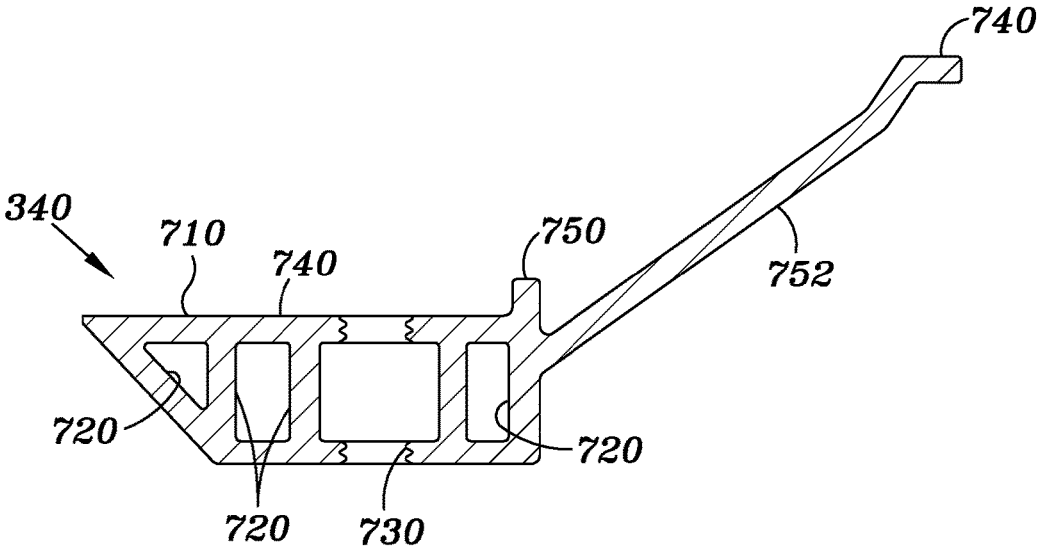
FIG. 7 is a cross sectional view of the interior frame of the frame assembly of FIG. 3.

Referring now to FIGS. 4, 6 and 7, the exterior frame 320 is formed having a body portion 610 having a top surface 622, a bottom surface 640 and an extension 620 extending from the body portion 610 for insertion into the slot 522 of the frame 310. As discussed in greater detail below, the cooperative engagement of the extrusion 620 within the slot 522 secures the frame 310 to the frame assembly 102, and thus, to the sectional door 100.

According to some embodiments, the body 610 includes a threaded opening 630 for receiving the fastener 350 (FIG. 4) to secure the exterior and interior frames 320 and 340 together. In that regard, the interior frame 340 includes a corresponding opening 730 such that when the interior frame 340 is aligned with the exterior frame 320, the opening 730 is co-axially aligned with the threaded opening 630 to receive the fastener 350 therein. In one embodiment, the opening 730 is a through hole and the fastener 350 passes through the opening 730 to engage with and otherwise be secured within the threaded opening 630. When the fastener 350 is tightened, the interior frame 340 and the exterior frame 320 are pulled toward each other to create a compressive load acting on the planar surface 148. As a result, the exterior frame 320 and the interior frame 340 secure the frame assembly 102 onto the sectional door 100 by clamping onto the planar surface 148. In the embodiment illustrated in FIGS. 3 and 4, the fastener 350 is a screw; however, it should be understood that fastener 350 may be substituted with other types of fasteners performing the same function. Additional and/or alternatively, the fastener 350 may include an adhesive, for example, to secure the exterior and interior frames 320 and 340 together.

With continued reference to FIGS. 4, 6 and 7, the exterior frame 320 further includes a raised edge or extension 650 for abutting against a corresponding raised edge or extension 750 of the interior frame 340. The extensions 650 and 750, when aligned and otherwise abutting each other as illustrated in FIG. 4, define a space between surfaces 640 and 740 to receive and otherwise enclose the shield member 330. Referring specifically to FIGS. 4 and 7, the interior frame 340 includes an arm member 752 extending from the body 710 and terminating at an end 754 to contact and otherwise abut the planar portion 148 of the sectional door 100. In the embodiment illustrated in FIG. 7, for example, the end 754 is formed having a planar surface configured to contact and otherwise abut the planar portion 148 of the sectional door 100 to prevent the frame assembly 102 from detaching from the door 100. In FIGS. 4 and 7, the arm member 752 extends angularly from the body 710 to contact the planar portion 148 and is generally straight; however, it should be understood that the arm member 752 may be otherwise configured. For example, the arm member 752 may be curved, may extend at different angles, may have a different thickness so long as the arm member 752 contacts the planar portion 148 to resist detachment of the frame assembly from the door 100. In some embodiments, the exterior frame 320 and the interior frame 340 include hollow compartments such as compartments 720 for saving material and/or reducing component weight, for example. It should be understood that the size, shape and number of hollow compartments 720 can vary depending on the desired configuration, size and weight of the frame assembly 102.

Figure 8A:
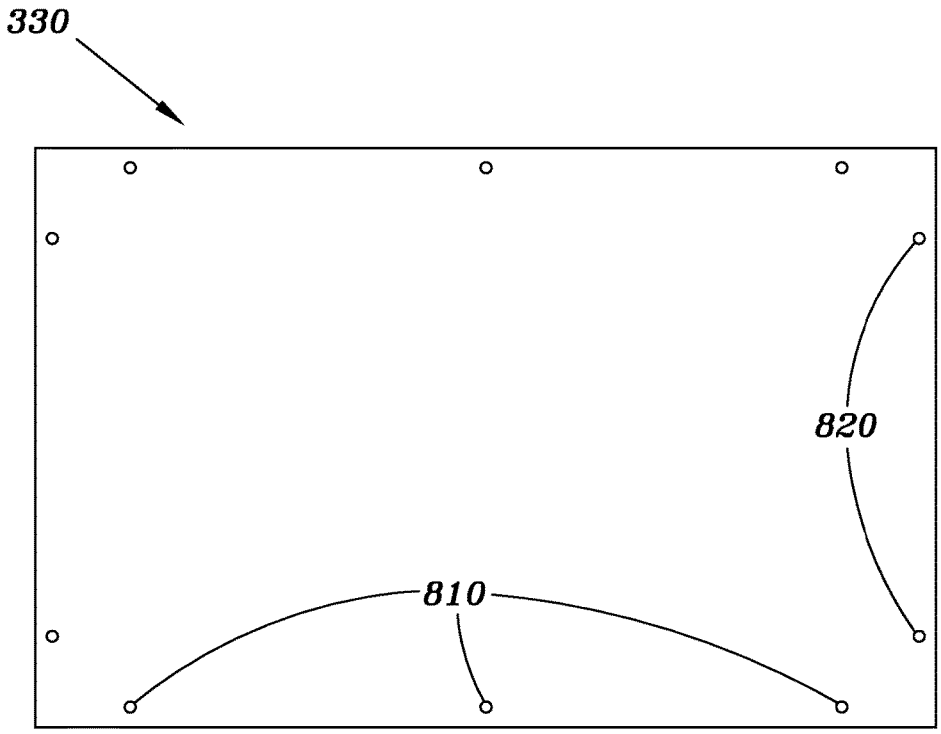
FIG. 8A is a front view of the shield member of the frame assembly of FIG. 3.

FIG. 8A is a front view and side view, respectively, of the shield member 330 of the frame assembly 102 of FIG. 3. According to embodiments disclosed herein, the shield member 330 may be a piece of polycarbonate, an acrylic sheet, silicon dioxide, or other material suitable for impact resistant windows. In some embodiments, the shield member 330 is transparent. In other embodiments, the shield member 330 may be translucent. In some other embodiments, the shield member 330 may be opaque.

Figure 8B:
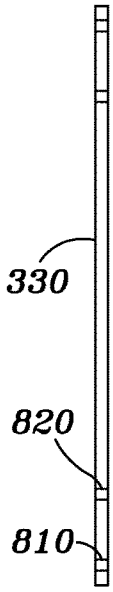
FIG. 8B is a side view of the shield member of FIG. 8A.

In the embodiment illustrated in FIGS. 8A and 8B, the shield member 330 includes spaced apart horizontal anchoring holes 810 and spaced apart anchoring holes 820. When assembled, two conditions may secure the shield member 330 in place. First, the anchoring holes 810 and 820 are held by the screws 350 that are inserted therethrough. Second, the interior frame 340 and the exterior frame 320 may provide a clamping load depending on the stiffness and dimensions of the raised edges 650 and 750. For example, in some instances the raised edges 650 and 750 are sized such that the combined lengths of the raised edges 650 and 750 are less than the thickness of the shield member 330 such that when assembled, provide a clamping force to retain the shield member 330 in place.

The assembly and installation of the frame assembly 102 onto the sectional door 100 is discussed hereinafter. After at least one panel opening 172 is formed in the planar surface 148 of the applicable door section 110, 112, and/or 114 the frame assembly can be installed onto the applicable door section 110, 112 and/or 114. Prior to installation, the extension 620 of the exterior frame 320 is inserted into the corresponding slot 522 of the frame 310. The exterior frame 320 is then installed, approaching from the front or outer side of the sectional door panel 110, 112, and/or 114, into the opening 172.

The shield member 330 is then placed in and/or is otherwise positioned adjacent the exterior frame 320, as best illustrated in FIG. 4. The interior frame 340 is then positioned to enclose and otherwise sandwich the shield member 330 with the exterior frame 320. Using a plurality of fasteners 350, the interior frame 340 is tightened against the exterior frame 320 to secure the frame assembly 102 to the applicable sectional door panel 110, 112, or 114. In particular, as the fasteners 350 are tightened, the bottom surface 640 of the exterior frame 320 is pulled into engagement with the planar portion 148 and the interior frame 340 is pulled into engagement with the shield member and the planar portion 148 via the arm member 752 so secure the shield member 330 inside the opening 172.

In some embodiments, sealing members such as, for example, seals 512 and 514 as illustrated in FIG. 5, are be used to seal the frame assembly 102. According to the embodiment illustrated in FIG. 5, the first sealing member 512 is disposed in the groove 536 near or otherwise adjacent the first end 518 and the second sealing member 514 is disposed in the groove 522 near the second end 520. In use, the seals 512 and 514 prevent debris and other contaminants from entering or otherwise lodging between the frame 310 and the planar portion of the door 148 and the shield member 330. As such, tightening the interior frame 340 to the exterior frame 320 would cause the sealing members 512 and 514 in the frame 310 to seal against the shield member 330 and the planar surface 148, effectively protecting the assembly from rain, dust, and other contaminants from entering the assembly.

According to some embodiments, the first sealing member 512 and the second sealing member 514 are formed of a rubber or other polymeric material deformable to conform and seal against abutting surfaces, such as for example, the gap between the decorative frame 310 and the planar portion 148 of the sectional door 110 and the decorative frame 310 and the shield member 330. In some embodiments, the first sealing member 512 and the second sealing member 514 are formed as part of the frame 310. For example, the frame 310 may be injection molded using two or more materials of different stiffness to enable a portion of the frame 310 to sealingly engage and otherwise contact the planar surface 148 and the shield member 330.

Yet in other embodiments, the lengths of raised edges 650 and 750 provide a distance greater than the thickness of the shield member 330, thus the shield member 330 is solely secured by the anchoring holes 810 and 820 when loaded. Specific configuration for securing the shield member 330 depends on its material property. For example, thermal expansion, ductility or brittleness, or tendency to crack, and other considerations may impact the particular configuration to be used to secure the shield member 330 in place.

Figure 9:
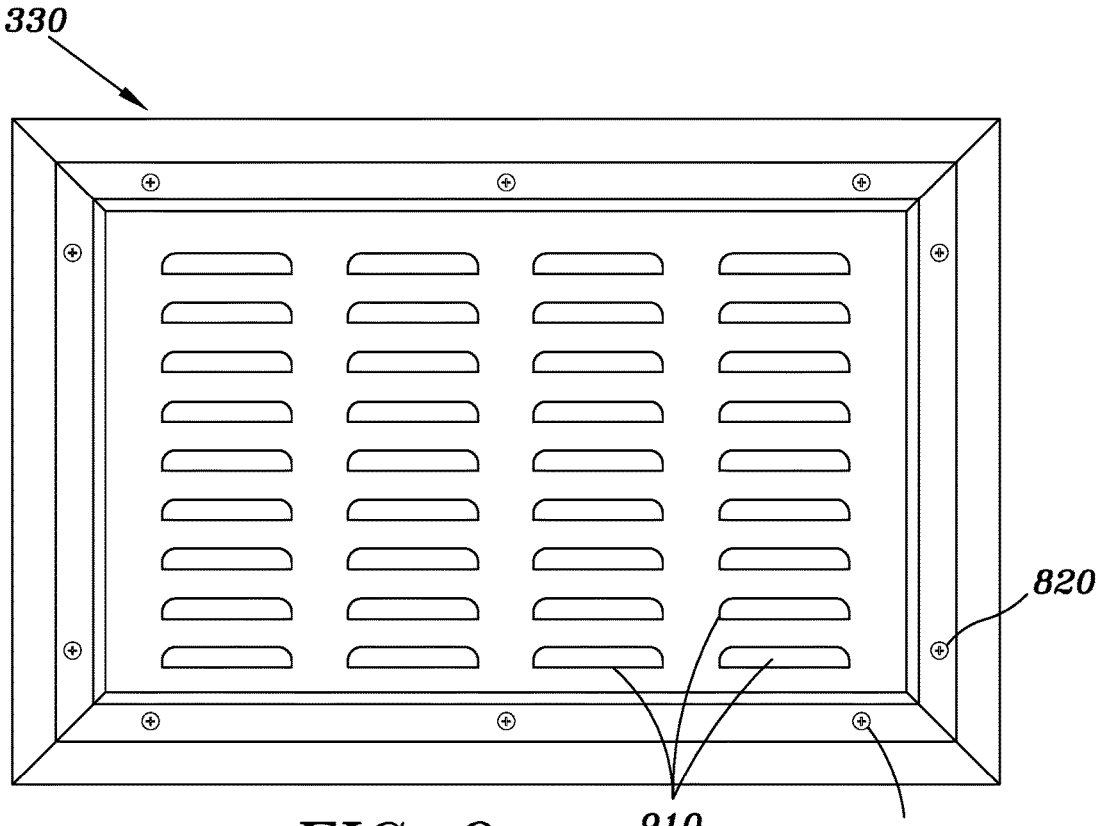
FIG. 9 is a front view of the frame assembly of FIG. 3 in which the shield member includes louvers.
Figure 10:
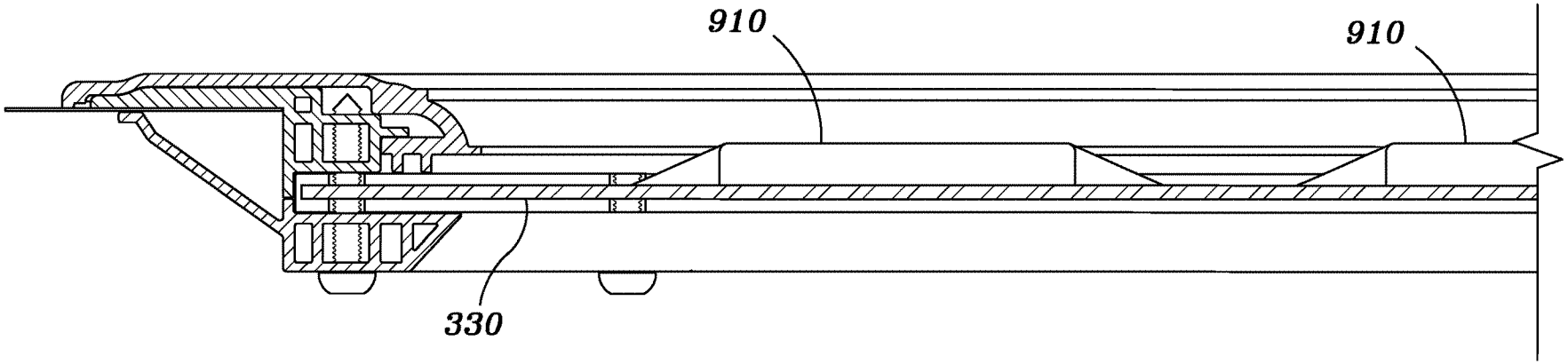
FIG. 10 is a local cross sectional view of the frame assembly of FIG. 9.

FIG. 9 is a front view of the frame assembly 102 of FIG. 3. In the embodiment illustrated in FIG. 9, the shield member 330 includes louvers 910. FIG. 10 is a local cross sectional view of the frame assembly of the configuration of FIG. 9. Referring to both FIGS. 9 and 10, the louvers 910 allow the passage of light and air while preventing the passage of rain therethrough. In the embodiment illustrated in FIG. 9, the louvers 910 are fixed. However, in other embodiments, the louvers 910 may have difference sizes relative to the shield member 330 and may be made adjustable. In one example, the shield member 330 with the louvers 910 is transparent such that the louvers 910 prevent only rain and dust from entering. In another example, the shield member 330 with the louvers 910 is opaque such that direct light and rain are shielded away. In such instance, the shield member 330 may be made of metal for strength and durability. In some embodiments, tightening the interior frame 340 toward the exterior frame 320 would reaching a dimension limit defined by the raised edges 650 and 750 that stops the interior frame 340 from further pressing the shield element 330 toward the exterior frame 320.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "outer" and "inner," "upper" and "lower," "first" and "second," "internal" and "external," "above" and "below" and the like are used as words of convenience to provide reference points and are not to be construed as limiting terms.

In addition, the foregoing describes only some embodiments of the invention(s), and alterations, modifications, additions and/or changes can be made thereto without departing from the scope and spirit of the disclosed embodiments, the embodiments being illustrative and not restrictive.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Although specific embodiments have been described in detail, those skilled in the art will also recognize that various substitutions and modifications may be made without departing from the scope and spirit of the appended claims.

What is claimed is:

1. An impact rated window frame assembly for support within an opening of a sectional door, the frame assembly comprising:

an interior frame member configured to be positioned on a first side of the sectional door;

an exterior frame member configured to be positioned on a second side of the sectional door opposite the first side;

a shield member disposed between the interior and exterior frame members; and a plurality of fasteners positioned, wherein the frame assembly is configured to be supported in the opening, to extend within the opening of the sectional door and through the interior frame member, the exterior frame member, and the shield member to secure the shield member between the interior and exterior frame members and to secure the interior and exterior frame members onto the sectional door.

2. The impact rated window frame assembly of claim 1, wherein the plurality of fasteners extends around a perimeter of the shield member.

3. The impact rated window frame assembly of claim 1, further comprising a decorative frame member, the decorative frame member interlocking with the exterior frame member, such that part of the decorative frame member is disposed between the exterior frame member and the shield member, to encircle the opening in the sectional door.

4. The impact rated window frame assembly of claim 3, wherein the decorative frame member includes a slot to receive a corresponding extension on the exterior frame member to interlock the decorative frame member to the frame assembly.

5. The impact rated window frame assembly of claim 3, wherein the decorative frame member comprises a first slot for holding a first sealing member that seals against a planar portion of the sectional door and a second slot for supporting a second sealing member against the shield member.

6. The impact rated window frame assembly of claim 5, wherein the first and the second sealing members are formed of a rubber material.

7. The impact rated window frame assembly of claim 1, wherein the exterior frame member comprises a threaded hole and the interior frame member comprises a through hole coaxially aligned with the threaded hole, the exterior frame member is fastened to the interior frame member by a screw extending through the coaxially aligned holes.

8. The impact rated window frame assembly of claim 1, wherein the exterior frame member further comprises a first raised edge for abutting against a second raised edge of the interior frame member to define a space for sandwiching the shield member.

9. The impact rated frame assembly of claim 1, wherein the shield member is transparent.

10. The frame assembly of claim 1, wherein the shield member includes a plurality of louvers.

11. A sectional door comprising:

at least one door panel movable between a closed and an open position, the at least one door panel having a planar surface;

at least one opening extending through the planar surface of the at least one door panel; and an impact rated window frame assembly, the frame assembly including:

an interior frame member configured to be positioned on a first side of the planar surface;

an exterior frame member configured to be positioned on a second side of the planar surface opposite the first side;

a shield member disposed between and supported by the interior and exterior frame members; and a plurality of fasteners positioned, wherein the frame assembly is configured to be supported in the opening, to extend within the opening of the sectional door and through the interior frame member, the exterior frame member, and the shield member to secure the shield member between the interior and exterior frame members and to secure the interior and exterior frame members onto the sectional door.

12. The sectional door of claim 11, wherein the plurality of fasteners extends around a perimeter of the shield member.

13. The sectional door of claim 12, wherein the decorative frame comprises a first slot for holding a first sealing member that seals against the planar portion of the sectional door and a second slot for holding a second sealing member that seals against the shield member.

14. The section door of claim 11, further comprising a decorative frame member, the decorative frame member interlocking with the exterior frame member, such that part of the decorative frame member is disposed between the exterior frame member and the shield member, to encircle the opening in the sectional door.

15. The sectional door of claim 14, wherein the decorative frame member includes a slot to receive a corresponding extension on the exterior frame member to interlock the decorative frame member to the frame assembly.

16. The sectional door of claim 11, wherein the exterior frame comprises an extrusion for inserting into a corresponding slot of the decorative frame, the decorative frame formed of an elastically deformable material.

17. The sectional door of claim 11, wherein the exterior frame member comprises a threaded hole and the interior frame member comprises a through hole aligned with the threaded hole such that the exterior frame member is fastened toward the interior frame member by a screw disposed within the aligned threaded holes.

18. The sectional door of claim 11, wherein the exterior frame member further comprises a first raised edge for abutting against a second raised edge of the interior frame member to define a space for enclosing the shield member.

19. An impact rated window frame assembly for support within an opening of a sectional door, the frame assembly comprising:

an interior frame member to be disposed on a first side of the sectional door;

an exterior frame member for support on a second side of the sectional door opposite the first side;

a shield member disposed between the interior and exterior frame members, wherein the shield member includes a plurality of louvers; and a plurality of fasteners extending through the interior frame member, the exterior frame member, and the shield member to secure the shield member between the interior and exterior frame members and to secure the interior and exterior frame members within the opening of the sectional door.

20. The impact rated window frame assembly of claim 19, further comprising a decorative frame member interlocking with the exterior frame member, part of the decorative frame is disposed between the exterior frame member and the shield member, to encircle the opening in the sectional door.

* * * * *